United States Patent [19]

Fitzgerald

[11] 4,360,861

[45] Nov. 23, 1982

[54] BASELESS LAMP SOCKET

[75] Inventor: James J. Fitzgerald, Kinnelon, N.J.

[73] Assignee: Edison International, Rolling Meadows, Ill.

[21] Appl. No.: 172,837

[22] Filed: Jul. 28, 1980

[51] Int. Cl.[3] ..... F21M 3/30

[52] U.S. Cl. ..... 362/211; 362/294; 362/296; 362/306; 362/369; 362/390; 362/438; 362/439; 362/441; 362/448

[58] Field of Search ..... 362/211, 294, 296, 306, 362/369, 390, 438, 439, 441, 448

[56] References Cited

U.S. PATENT DOCUMENTS 4,100,448 7/1978 Chipner ..... 362/306

4,319,156 3/1982 Bienvenue ..... 362/211

*Primary Examiner*—Stephen J. Lechert, Jr.

*Attorney, Agent, or Firm*—Ronald J. LaPorte; Jon C. Gealow; Charles W. MacKinnon

[57] ABSTRACT

The invention relates to a socket for a baseless cartridge lamp, particularly a two-filament cartridge lamp or a cartridge halogen lamp with contacts at opposite ends thereof.

29 Claims, 3 Drawing Figures

BASELESS LAMP SOCKET

BACKGROUND OF THE INVENTION

Two filament baseless cartridge lamps are known and may for example be manufactured as described in U.S. Pat. No. 4,061,940 which is incorporated herein by reference. A cooperating socket for the baseless bulb is also described in the foregoing patent; however, the socket disclosed is not practical for mounting the lamp in a reflector and in general would not allow ease of replacement from the rear of a typical reflector assembly. While the socket described in the patent, in cooperation with the lamp, solved general significant problems in the prior art, particularly in terms of registration of the filaments in relation to the mounting supports, there remain other problems associated with this socket as well as with sockets for based bulbs. For example, whenever the lamp is operated in an environment where shocks and vibration occur, as in a vehicle headlamp, the life expectancy of prior art filament bulbs has been considerably reduced. A minor bump, in many instances, can destroy the lamp simply by causing the filament to snap.

SUMMARY OF THE INVENTION

A socket for a baseless two-filament lamp of the type described in U.S. Pat. No. 4,061,940 provides means to axially support and position the lamp with respect to the socket. The body of the socket is made of an insulative material in which terminals or flexible wires may be inserted or molded to provide external access to an electrical circuit. Internal terminals provide support for the lamp, proper registration of the filaments, and electrical continuity for energization of the filaments.

The internal terminals comprise two socket pins which are adapted to hold the filament support pins of the baseless lamp and a supporting contact. The supporting contact is a loop which is adapted to engage the square loop of the cartridge lamp to hold it between the support contact and the socket pins so that its axis is parallel to the axis of the socket. The supporting contact may be of any electrically conducting material, and for best results the support has spring like characteristics so that the lamp may be mounted in tension between the socket pins at one end and the support contact at the other.

The socket body may be made of an insulation material, and preferably of an elastomer in which case the flexibility of the resilient body cushions any shock to the filaments of the bulb as well as enabling a more efficient seal to keep dust and vapor from the interior of the reflector in which the lamp may be mounted. The supporting contact supports the lamp elastically and in conjunction with the resilient body material substantially reduces the shocks and vibration to which the lamp might ordinarily be subjected.

When utilizing the socket according to this invention, the lamp can be mounted in an axial position in the reflector and the size of the connector is thereby minimized. This reduction enables maximum use of a reflector's surface by providing substantially the minimum mounting configuration space. Concurrently, therefore, substantially the maximum space for lamp replacement is available in any environment.

Further features and advantages of the socket according to the invention will be understood from the description of the preferred embodiments shown in the drawings.

Figure 1:
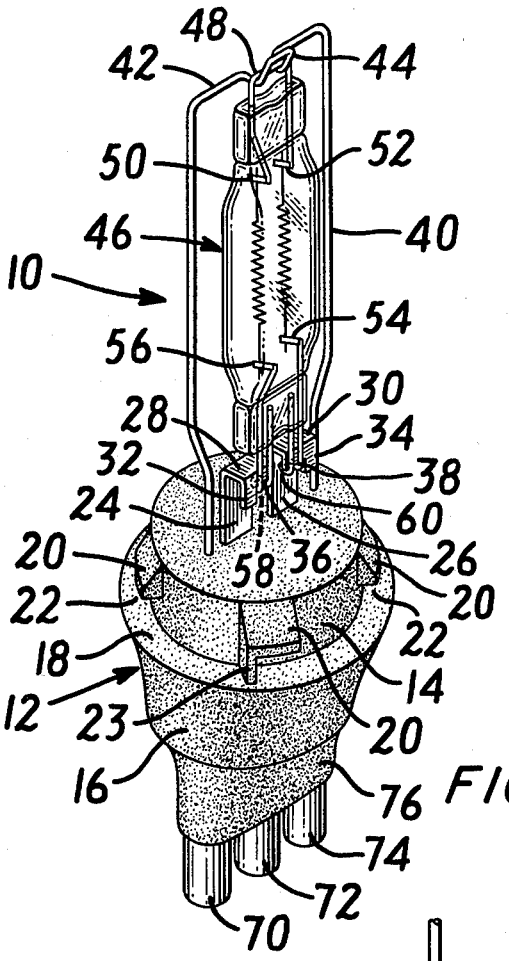
FIG. 1 is a view of the socket with a baseless two-filament cartridge lamp mounted in place.

In FIG. 1, a socket according to the invention is shown generally at 10. A molded neoprene body 12 of generally circular cross section has an upper part 14 of relatively smaller cross section joining a lower part 16 of larger, cross section to create a shoulder 18. Four ears 20, symmetrically disposed around the circumference of the upper part 14, project out from the surface and terminate at approximately the outer circumference of the shoulder 18. The ears 20 form mounting slots 22 between themselves and shoulder 18. A vertical extension 23 of one of the ears 20 into the slot 22 between the ear 16 and the shoulder 18 is adapted to act as a registration stop to assure proper orientation of the filaments in a reflector or other mount (not shown).

Two cadminum-coated steel socket pins 24 and 26 are molded into the body of the socket. Alternatively they may be inserted and locked into position by other means known in the art. Socket pins 24 and 26 are positioned parallel to each other along a chordal line through the circular cross section of body 12. The pins project out above the top of body 12 and terminate at the top in two right angle bends (28 and 30) forming a J-shaped arrangement. The ends of each J have outboard tangs (32 and 34) forming inboard shoulders (36 and 38) on the opposing sides of the socket pins (24 and 26).

A generally U-shaped supporting contact 40 has the lower part of the two legs of the U molded into the body 12 of socket 10. The supporting contact 70 may be a cadmium-coated steel wire, but it is preferably phosphor-bronze wire, and the vertical distance between the top of the socket and top of the loop is slightly greater than that of the cartridge lamp 46 to be supported. In the view shown, the top portion 42 of the supporting contact 40 has means thereon for engaging a contact at one end of the cartridge lamp. The means most conveniently comprise a smaller hairpin loop 44. The loop 44 extends out from the supporting contact 40 and at an angle pointing upwardly away from the socket pins 24 and 26.

As described below, the socket pins (24 and 26) and the supporting contact 40 are adapted to position and hold a two-filament cartridge bulb in axial alignment with the socket base. A conventional two-filament baseless cartridge lamp 46 such as that described in U.S. Pat. No. 4,061,940, has a loop 48 formed externally at one end of the lamp and which continues through the seal into the lamp as filament support pins 50 and 52. At the other end of the lamp, there are a pair of spaced generally U-shaped filament support pins 54 and 56, the legs of which are secured in the seal of the glass. The bottom of the U of the support pins 54 and 56 extend out beyond the seal of the glass envelope and the bottom and portions of the U are bent over to form a hook 58 and 60 respectively. It will be understood that a single wire or strip support pin may be employed for each filament of the lamp and each provided with a hook outside the lamp envelope. Preferably the outer portion 58 and 60 of each hairpin shape is bent about an axis lying perpendicular to the axis of the lamp through an angle greater than 90° to form rigid hooks.

Loop 44 of supporting contact 40 is adapted to be inserted into the square loop 48 of the lamp 46. The width of the hairpin loop 44 is less than the interior dimension of the square loop 32 and is adapted to hook into and suspend the lamp.

Socket pins 24 and 26 are adapted to holding the hooked ends 58 and 60 of the respective filament support pins 54 and 56. The two hooks of filament support pins 54 and 56 are slipped over the J-shaped portion of the socket pins 24 and 26 to rest in abutment against the inboard shoulders 36 and 38 of the outboard tangs 32 and 34. The space between the lateral shoulders 36 and 38 snugly matches the outboard dimensions of support pins 54 and 56 and thereby fixes the lateral position of this end of the lamp.

In the unstressed condition, the space between the bearing support portion of tangs 32 and 34 of socket pins 24 and 26 and the bearing portion of the supporting contact 40 at loop 44 slightly exceeds the distance between the corresponding bearing surfaces of loop 48 and hooks 58 and 60 of the lamp support pins 54 and 56 respectively. Thus, in order to hook the filament support pins into their respective terminals, the supporting contact 40 must be manually deflected downward. The lamp is thus elastically suspended in an axial position by the loop 40 captured by the hairpin 44 of the supporting contact and the hooks of the filament support pins 54 and 56 are captured by the socket pins 24 and 26. It will be clear to one skilled in the art that other means of suspending the lamp such as wire-crimping and spot welding may be employed for suspending the cartridge lamp. It is equally clear that a single filament lamp having a single exposed contact at each of the opposite ends of the bulbs could be used in which case only a single socket pin is required in conjunction with the supporting contact 40.

The body 12 of the socket has molded therein external connecting wires 70, 72, and 74. Lead 70 is electrically connected to socket pin 24, lead 72 connects to socket pin 26 and lead 74 is electrically connected to the supporting contact 40 in conventional manner to provide an electric circuit for the lamp filaments. Preferably the connections are made during molding of the socket assembly. The lower portion of the body is shown decreasing smoothly and circumferentially to an oval cross section 76 having the wires 70, 72, and 74 molded therein. Other forms, of course, may be selected for a particular application. Alternatively, the external contacts may be made through any of the well-known terminal extensions for connecting to another cooperating socket.

Figure 2:
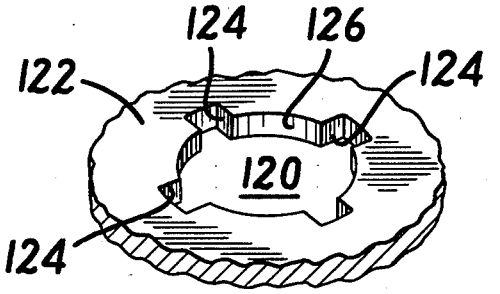
FIG. 2 is a perspective drawing of a second embodiment of the socket.
Figure 2:
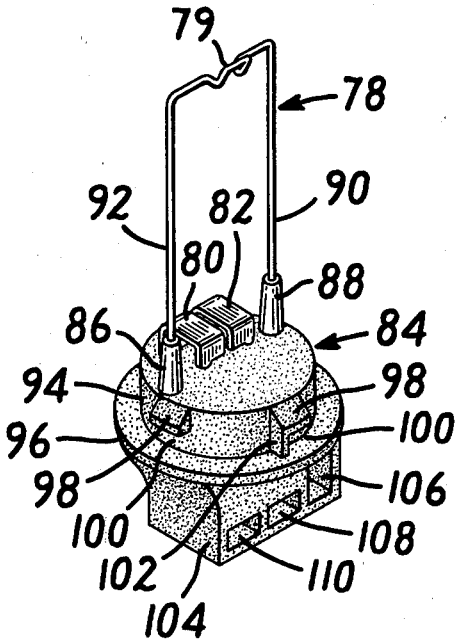

FIG. 2 is a second embodiment of the invention in which there are molded-in terminals for external connections at right angles to the socket axis to corresponding self-locking connectors. In this embodiment a generally U-shaped support contact 78 and socket pins 80 and 82 are molded into an elastomeric socket such as a neoprene socket 84. As in the previous embodiment, support contact 78 has a mounting loop 79 and each of the socket pins 80 and 82 have J-shaped flanges with tangs 81 and 83 respective for mounting the bulb. The support contact and socket pins are made of conventional electrically conductive materials. The supporting contact 78 has neoprene molded support stanchions 86 and 88 where the legs 90 and 92 of the contact 78 emerge from the body for the purpose of further stiffening the support contact 78. The socket is adapted to support a baseless two-filament cartridge lamp in elastic suspension between the supporting contact 78 and the two socket pins 80 and 82 as described in conjunction with FIG. 1.

In this embodiment, the body 84 consists of an upper portion 94 of relatively smaller circular cross section above an annular ring 96 of larger diameter. Four ears 98 (two of which are not shown) project from the portion 94 and extend substantially to the outer circumference of the annular ring 96 leaving spaces 100 between the ears 98 and the annular ring 96. A vertical extension 102 at one side of one of the ears serves as a registration stop.

The lower portion of the body 104 is formed in generally rectangular cross-section surmounted by the annular ring 96 and having three keyable spaced cavities 106, 108, and 110 for receiving external connection of electrical power to the lamp socket.

Figure 3:
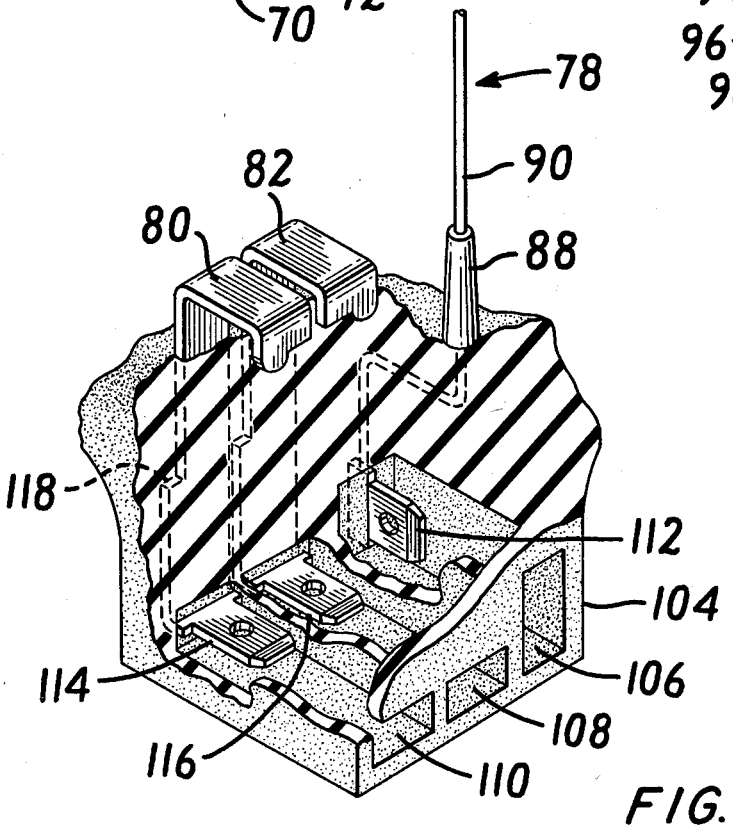
FIG. 3 is a detail of the interior of the socket of FIG. 2.

As best shown in FIG. 3, one leg of the supporting contact wire 78 is electrically connecting to a male blade terminal 112 at the end of cavity 106 for connection to a corresponding mating female connector (not shown).

The two socket pins 80 and 82 of this embodiment each have at the base thereof blade-type male terminals 114 and 116 respectively and at the other end, the J-shaped arrangements as described in FIG. 1. A shoulder 118 on the midportion of said socket pins 80 and 82 within the body 104 serves to lock the terminals in place.

As is shown in FIG. 2, but which ia also applicable to the embodiment of FIG. 1, the upper portion of the socket is adapted to be inserted through a corresponding hole 120 in a reflector 122 (only a portion of which is shown) or other desired mounting body having notches 124 in its circumference corresponding to the ears 98 on the circumference of the smaller upper portion 94. The space 100 between the ears 98 and the annular ring 96 is matched to the thickness 126 of the holding area of the reflector or holding body. Upon insertion through the hole, the ring 96 is in abutment with the reflector, and a slight rotation of the body brings the ears 98 to a position to lock the socket against outward pressure. The extension 102 of one of the ears through the distance between the shoulder and the ears serves as a registration stop to allow precise positioning of the bulb when the socket is twisted to lock the socket in place. Best results are achieved by positioning the bulb at the focal point of the reflector such as a vehicle head lamp or tail reflector and the space 100 between the ears 98 and annular ring 96 may be somewhat smaller than the thickness 126 of the reflector for a snug elastic fit.

The socket body, being made of neoprene, offers an elastic resistance to the holding portion snugly fitted between the ears and the shoulder, thereby providing a tight seal for keeping dust and moisture out of, for instance, a sealed vehicle lamp reflector.

Other keying arrangements may be selected and the invention is not to be limited to the two embodiments described herein. In addition, the loop filament support does not have to be of rectangular cross-section as illustrated herein and other forms of rigid supporting contact such as ovals, non-planar supports, and such like are also contemplated.

It is to be understood that the invention is not to be limited to the embodiments herein chosen for the purpose of illustration and is intended to cover all changes and modifications within the scope and spirit of the invention.

What is claimed is:

1. A socket for a baseless cartridge lamp, said baseless cartridge lamp being the type having exposed filament support means at one end and exposed filament support means at the other end thereof, comprising:

(a) a body;

(b) two socket pins extending from said body a first distance, said two socket pins being electrically conducting and operative at one end thereof for engaging one of said filament support means of said baseless cartridge lamp when associated therewith;

(c) a supporting contact;

(d) said supporting contact being an electrically conducting loop extending a second distance from said body in substantially the same direction as said two socket pins;

(e) means on said supporting contact for engaging the other filament support means of said cartridge lamp when associated therewith;

(f) said two socket pins and said means for engaging being operative to suspend said cartridge lamp when associated therewith between said socket pins and said supporting contact;

(g) means on said body for securing said body in a cooperating holder; and (h) means for respectively electrically connecting said two socket pins and said supporting contact to external sources of electrical power.

2. The socket of claim 1 wherein said body is made of a resilient material.

3. The socket of claim 2 wherein said resilient material is rubber.

4. The socket of claim 2 wherein said resilient material is neoprene rubber.

5. The socket of claim 1 wherein said supporting contact is a loop of cadmium plated steel wire.

6. The socket of claim 1 wherein said supporting contact is a loop of phosphor-bronze wire.

7. The socket of claim 1 wherein said two contact pins have J-shaped ends adapted to capture said one filament support means when associated therewith.

8. The socket of claim 7 wherein said J-shaped ends have outboard tangs forming shoulders thereon, said socket pins are aligned along a chordal section of said body, and said shoulders are adapted for centering said one filament support means therebetween when associated therewith.

9. The socket of claim 1 wherein said means for engaging said other filament support means is a wire crimp.

10. The socket of claim 1 wherein said means for engaging is spot welding.

11. The socket of claim 1 wherein said means for engaging is a hairpin loop in a midportion of said support contact, said hairpin loop being adapted for engaging said other filament support means when associated therewith.

12. The socket of claim 11 wherein said supporting contact and said socket pins are operative to suspend said baseless cartridge lamp when associated therewith in tension therebetween.

13. The socket of claim 1 wherein said means for securing comprises:

(a) said body having an upper portion of relatively smaller circular cross section joining a lower portion of relatively larger circular cross section to form a shoulder thereon.

(b) ears on said upper portion therefrom and spaced from said shoulder;

(c) said ears and said shoulder being adapted to cooperate to snugly hold a mounting section in the space therebetween.

14. The socket of claim 13 wherein said shoulder is formed as an annular ring on said body.

15. The socket of claim 13 further comprising an extension of at least a portion of one of said ears into the space between said ear and said shoulder, said extension being adapted to serve as a registration stop for alignment of said socket.

16. The socket of claim 1 wherein said means for electrically connecting are a plurality of wires molded into said body.

17. The socket of claim 1 wherein said means for electrically connecting are terminals respectively positioned in a plurality of open cavities within said body.

18. A baseless cartridge lamp and socket therefor comprising:

(a) a baseless cartridge lamp having two filament support exposed pins at one end and a filament support loop exposed at the other end thereof;

(b) a body;

(c) two socket pins extending from said body a first distance, said two socket pins being electrically conducting and operative at one end thereof to engage said two filament-support pins of said baseless cartridge lamp;

(d) a supporting contact;

(e) said supporting contact being an electrically conducting loop extending a second distance from said body in substantially the same direction as said two socket pins;

(f) means on said supporting contact for engaging said filament support loop of said cartridge lamp;

(g) said two socket pins and said means for engaging being operative to suspend said cartridge lamp between said socket pins and said supporting contact; said lamp being suspending axially in relation to said body;

(h) means on said body for securing said body in a cooperating holder; and (i) means for respectively electrically connecting said two socket pins and said supporting contact to external sources of electrical power.

19. A lamp reflector assembly comprising:

(a) a reflector defining an interior of said lamp reflector assembly and having an opening therein;

(b) a baseless cartridge lamp having two filament support pins at one end and a filament support loop at the other end thereof;

(c) a socket for said baseless cartridge lamp, said socket suspending said baseless cartridge lamp, and secured in said opening of said reflector to suspend said baseless cartridge lamp therein, said socket comprising:

(i) a body;

(ii) two socket pins extending from said body a first distance into said interior of said reflector assembly, said two socket pins being electrically conducting and operative at the end thereof to engage said two filament support pins of said baseless cartridge lamp;

(iii) a supporting contact;

(iv) said supporting contact being an electrically conducting loop extending further into said interior in spaced relationship to said socket pins;

(v) a hairpin loop in said support contact, said hairpin loop being adapted for insertion into said filament support loop;

(vi) said supporting contact and said socket pins being operative to suspend said cartridge lamp between said socket pins and said supporting contact so that said lamp is adapted for insertion through said opening in said reflector;

(vii) means for external electrical contact of said supporting contact and said socket pins;

(viii) said body having an end portion of relatively smaller circular cross section joining a middle portion of relatively larger circular cross section to form a shoulder;

(ix) ears on said upper portion projecting therefrom and spaced from said shoulder;

(d) said opening in said reflector having cross section and notches for cooperatively receiving said upper portion; and (e) said ears and said shoulder being operative to lock said socket into said lamp reflector assembly upon rotation of said socket; said shoulder being in tight abutment against said reflector.

20. The lamp-reflector assembly of claim 19 wherein said body is made of neoprene rubber.

21. The lamp-reflector assembly of claim 19 wherein said shoulder is formed by an annular ring on said body.

22. A socket for a baseless cartridge lamp, said baseless cartridge lamp being the type having two filament support pins at one end and a filament support loop at the other end thereof, comprising:

(a) a neoprene body;

(b) two cadmium coated steel socket pins extending from said neoprene body a first distance, said two cadmium coated steel socket pins being operative at one end thereof to engage said two filament-support pins of said baseless cartridge lamp;

(c) a phosphor-bronze supporting contact;

(d) said phosphor-bronze supporting contact being a loop extending a second distance from said body in substantially the same direction as said two cadmium coated steel socket pins;

(e) a hairpin loop in a mid-portion of said phosphor-bronze supporting contact for engaging said filament supporting loops of said cartridge lamp;

(f) said two cadmium coated steel socket pins having J-shaped ends adapted to capture said two filament support pins, said J-shaped ends having outboard tangs forming shoulders thereon adapted for centering said two-filament support pins therebetween;

(g) said two cadimum coated steel socket pins and said means for securing being operative to suspend said cartridge lamp in tension between said cadmium coated steel socket pins and said phosphor-bronze supporting contact said lamp being suspending axially in relation to said body;

(h) said neoprene body having an upper portion of relatively smaller circular cross-section joining a lower portion of relatively larger circular cross-section to form a shoulder thereon;

(i) ears on said upper portion projecting therefrom and spaced apart from said shoulder;

(j) said ears and said shoulder being adapted to cooperate to snugly hold a mounting section in the space therebetween; and (k) a plurality of terminal wires molded into said neoprene body for respectively electrically connecting said two cadmium coated steel socket pins and said phosphor-bronze supporting contact to external sources of electric power.

23. A socket for a baseless cartridge lamp, said baseless cartridge lamp being the type having two filament support pins at one end and a filament support loop at the other end thereof, comprising:

(a) a neoprene body;

(b) two cadmium coated steel socket pins extending from said neoprene body a first distance, said two cadmium coated steel socket pins being operative at one end thereof to engage said two filament-support pins of said baseless cartridge lamp;

(c) a phosphor-bronze supporting contact;

(d) said phosphor-bronze supporting contact being a loop extending a second distance from said body in substantially the same direction as said two cadmium coated steel socket pins;

(e) a hairpin loop in a mid-portion of said phosphor-bronze supporting contact for engaging said filament supporting loops of said cartridge lamp;

(f) said two cadmium coated steel socket pins having J-shaped ends adapted to capture said two filament support pins, said J-shaped ends having outboard tangs forming shoulders thereon adapted for centering said two-filament support pins therebetween;

(g) said two cadmium coated steel socket pins and said means for securing being operative to suspend said cartridge lamp in tension between said cadmium coated steel socket pins and said phosphor-bronze supporting contact said lamp being suspending axially in relation to said body;

(h) said neoprene body having an upper portion of relatively smaller circular cross-section joining a lower portion of relatively larger circular cross-section to form a shoulder thereon;

(i) ears on said upper portion projecting therefrom and spaced apart from said shoulder;

(j) said ears and said shoulder being adapted to cooperate to snugly hold a mounting section in the space therebetween; and (k) a plurality of terminals respectively positioned in a plurality of open cavities within said neoprene body for respectively electrically connecting said two cadmium coated steel socket pins and said phosphor-bronze supporting contact to external sources of electric power.

24. A socket for supporting a baseless cartridge lamp in a reflector comprising:

(a) a molded body of insulating material;

(b) first exposed electrically conductive contact means at one side of said body;

(c) second electrically conductive contact means extending out from said body in spaced relationship to said first contact means with the length of the space between said first and second contact means being in position to project out away from the surface of said socket body;

(d) at least one of said contact means having spring like characteristics and being operative in cooperation with said other contact means for elastically supporting said cartridge lamp when mounted in the space between said first and second contact means; and (e) mounting means carried by said molded body for supporting said socket when mounted in a reflector.

25. The structure of claim 24 in which the length of the space between said first and second contact means projects away from the surface of the socket at substantially a right angle thereto.

26. A socket for mounting a baseless cartridge lamp in a vehicle headlamp reflector comprising:

(a) a molded elastomeric body of insulating material having;

(b) first electrically conductive contact means molded into said body and exposed at one side thereof;

(c) second electrically conductive contact means molded into said body to extend out from said body in spaced relationship to said first contact means with the length of the space between said first and second contact means being in position to project out away from the surface of said socket body;

(d) at least one of said contact means having spring like characteristics and being operative in cooperation with said other contact means to support said cartridge lamp under tension when mounted in the space between said first and second contact means; and (e) mounting means on said molded body for supporting said socket when mounted in a vehicle head lamp reflector.

27. In a vehicle lamp assembly comprising:

a reflectior having an opening therein for insertion of a lamp; and a lamp having first exposed contact means at one end thereof and second exposed contact means at the opposite end thereof; the improvement comprising: a molded socket of insulating material for supporting said lamp; said socket having first electrically conductive support means engaged with one of the exposed contact means of said lamp, second electrically conductive support means engaged with the second exposed contact means of said lamp to support said lamp in position to extend out away from a surface of said socket and mounting means which cooperate with said reflector opening to support said socket in the reflector opening with the lamp projecting into said lamp assembly beyond the surface of said socket.

28. The structure of claim 27 in which the lamp projects through the focal point of said reflector in the lamp assembly.

29. The structure of claim 27 in which the longest dimension of the lamp projects into the reflector at substantially a right angle to the surface of the socket.

* * * * *